US009299221B2

(12) United States Patent
Santosh et al.

(10) Patent No.: US 9,299,221 B2
(45) Date of Patent: Mar. 29, 2016

(54) SYSTEM AND METHOD FOR ALLOWING PLAYERS TO PLAY MATCHING GAMES HAVING PATHS FORMED BETWEEN SYMBOLS

(71) Applicant: BitRhymes Inc., Foster City, CA (US)

(72) Inventors: Alampalayam Palaniswamy Santosh, Bangalore (IN); Vikas Gupta, San Francisco, CA (US)

(73) Assignee: GSN Games, Inc., Santa Monica, CA (US)

( * ) Notice: Subject to any disclaimer, the term of this patent is extended or adjusted under 35 U.S.C. 154(b) by 25 days.

(21) Appl. No.: 13/954,295

(22) Filed: Jul. 30, 2013

(65) Prior Publication Data

US 2015/0038211 A1 Feb. 5, 2015

(51) Int. Cl.
*G07F 17/32* (2006.01)
*A63F 3/06* (2006.01)

(52) U.S. Cl.
CPC ..... *G07F 17/329* (2013.01); *A63F 3/0645* (2013.01); *G07F 17/3218* (2013.01)

(58) Field of Classification Search
CPC ... G07F 17/3286; G07F 17/329; G07F 17/32; A63F 3/0645
See application file for complete search history.

(56) References Cited

U.S. PATENT DOCUMENTS 5,482,289 A 1/1996 Weingardt
5,935,002 A * 8/1999 Falciglia ..... 463/19
6,079,711 A 6/2000 Wei et al.
6,656,044 B1 12/2003 Lewis
7,837,550 B2 11/2010 Odom
8,123,607 B2 2/2012 Van Asdale
8,201,827 B2 6/2012 Weingardt
8,387,985 B1 3/2013 Itkis et al.
2003/0064772 A1 4/2003 Tempest et al.
2004/0242313 A1 12/2004 Munoz
2005/0059470 A1* 3/2005 Cannon ..... 463/19
2005/0059471 A1* 3/2005 Cannon ..... 463/19
2005/0119042 A1* 6/2005 Chamberlain et al. ..... 463/19
2006/0035699 A1* 2/2006 Falciglia ..... 463/19
2006/0052160 A1 3/2006 Saffari et al.
2009/0247258 A1 10/2009 Anderson
2012/0009987 A1* 1/2012 Dumont et al. ..... 463/19
2014/0018143 A1* 1/2014 Yarbrough ..... 463/19
2014/0274280 A1* 9/2014 Macbeth et al. ..... 463/19
2015/0141110 A1 5/2015 Gupta et al.
2015/0141111 A1 5/2015 Gupta et al.

* cited by examiner

*Primary Examiner* — Jay Liddle
*Assistant Examiner* — Alex F. R. P. Rada, II
(74) *Attorney, Agent, or Firm* — Knobbe, Martens, Olson & Bear, LLP

(57) ABSTRACT

A method for allowing players to play a bingo-type game with a gaming system is described herein. The method includes displaying the bingo-type game on the display device, randomly selecting a plurality of player symbols, randomly selecting a plurality of game symbols, determining if each one of the plurality of game symbols matches a corresponding one of the plurality of player symbols, and determining a game outcome of the bingo-type game as a function of the matched player symbols. The method also includes determining if a triggering condition occurs in the game outcome and responsively providing an award to the player if the triggering condition occurs. The triggering condition is defined as a path extending between the origin symbol and the destination symbol and including at least one matched player symbol.

6 Claims, 13 Drawing Sheets

SYSTEM AND METHOD FOR ALLOWING PLAYERS TO PLAY MATCHING GAMES HAVING PATHS FORMED BETWEEN SYMBOLS

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The subject matter disclosed herein relates generally to a system for allowing players to play matching games and more particularly, to methods and systems for allowing players to play bingo-type games that include a winning condition defined as a path being formed between game symbols.

BACKGROUND OF THE INVENTION

At least some known gaming systems display video based games such as bingo-type games that allow players to purchase bingo cards for use in playing the bingo-type game. Each bingo card includes a randomly selected sub-set of numbers from a pre-defined set of numbers. During play of the bingo-type game, the gaming system conducts a draw in which a plurality of numbers are randomly selected from the predefined set of numbers. During the draw, the player compares the drawn number with the numbers displayed on the purchased bingo cards to determine if a match occurs between the drawn number and the numbers displayed on the bingo cards. The player marks, or daubs, each corresponding matched number on the bingo card and indicates a winning outcome when the matched numbers forms a complete row and/or column on the bingo card. The gaming system verifies the winning outcome and responsively provides an award to the player based on the winning outcome indicated on the bingo card.

Over time, during game play, the player may become frustrated because the chances of receiving an award are based only on the number of matches made between the numbers selected during the draw and the predefined set of numbers displayed on the player's bingo card. Accordingly, new features are necessary to appeal to player interest and enhance excitement in order to entice longer play and increased profitability. The present invention is directed to satisfying these needs.

SUMMARY OF THE INVENTION

The invention is generally directed to systems and methods for allowing players to play bingo-type games having a winning condition defined as a path being formed between two or more game symbols.

In one aspect of the invention, a system for allowing players to play a bingo-type game with a user computing device is provided. The system includes a plurality of user computing devices, wherein each user computing device includes a user input device for accepting a user's selection input and a display device. A system controller is coupled to each user computing device and is configured to receive, from at least one of the user computing devices, a request from a player to play the bingo-type game and responsively display the bingo-type game on the display device. The bingo-type game includes a plurality of symbols being displayed in a plurality of symbol positions, wherein the plurality of symbols include at least one origin symbol and at least on destination symbol. The system controller is also configured to randomly select a plurality of player symbols and display the selected plurality of player symbols in the plurality of symbol positions. The system controller also randomly selects a plurality of game symbols, determines if each one of the plurality of game symbols matches a corresponding one of the plurality of player symbols, and determines a game outcome of the bingo-type game as a function of the matched player symbols. The system controller also determines if a triggering condition occurs in the game outcome and responsively provides an award to the player if the triggering condition occurs. The triggering condition is defined as a path extending between the origin symbol and the destination symbol and including at least one matched player symbol.

In another aspect of the invention, a method for allowing players to play a bingo-type game with a gaming system is provided. The method includes receiving a signal indicative of a request from a player to play the bingo-type game and responsively displaying the bingo-type game on the display device. The bingo-type game includes a plurality of symbols being displayed in a plurality of symbol positions. The plurality of symbols include at least one origin symbol and at least on destination symbol. The method also includes randomly selecting a plurality of player symbols and displaying the selected plurality of player symbols in the plurality of symbol positions, randomly selecting a plurality of game symbols, determining if each one of the plurality of game symbols matches a corresponding one of the plurality of player symbols, and determining a game outcome of the bingo-type game as a function of the matched player symbols. The method also includes determining if a triggering condition occurs in the game outcome and responsively providing an award to the player if the triggering condition occurs. The triggering condition is defined as a path extending between the origin symbol and the destination symbol and including at least one matched player symbol.

In yet another aspect of the invention, one or more non-transitory computer-readable storage media, having computer-executable instructions embodied thereon is provided. The computer-executable instructions, when executed by at least one processor, cause the processor to display a bingo-type game on a display device in response to receiving a signal indicative of a request from a player to play the bingo-type game. The bingo-type game includes a plurality of symbols being displayed in a plurality of symbol positions, wherein the plurality of symbols includes at least one origin symbol and at least on destination symbol. The computer-executable instructions also cause the processor to randomly select a plurality of player symbols and display the selected plurality of player symbols in the plurality of symbol positions, to randomly select a plurality of game symbols, to determine if each one of the plurality of game symbols matches a corresponding one of the plurality of player symbols, and to determine a game outcome of the bingo-type game as a function of the matched player symbols. The computer-executable instructions also cause the processor to determine if a triggering condition occurs in the game outcome and responsively provide an award to the player if the triggering condition occurs, wherein the triggering condition is defined as a path extending between the origin symbol and the destination symbol and including at least one matched player symbol.

BRIEF DESCRIPTION OF THE DRAWINGS

Other advantages of the invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
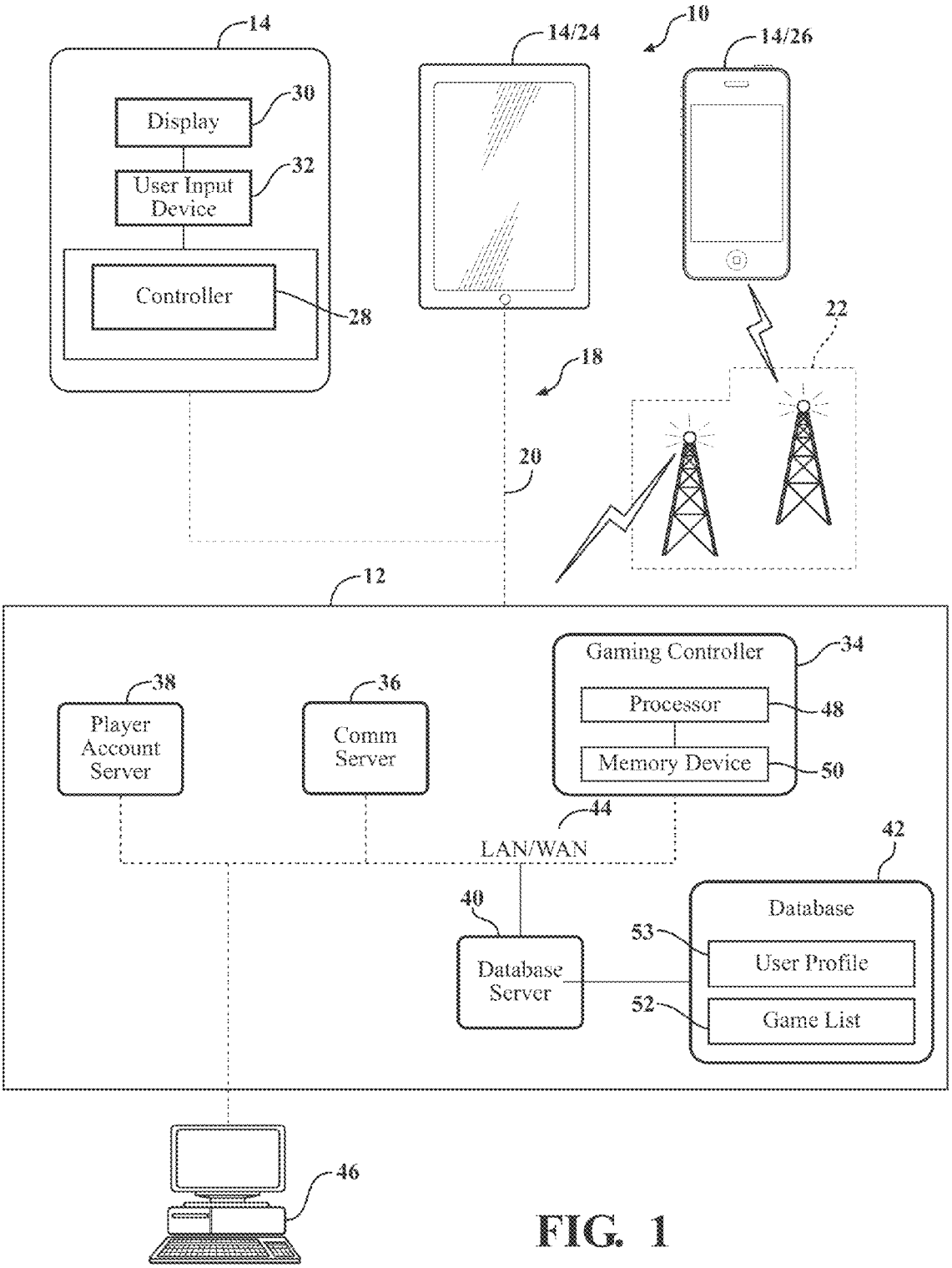
FIG. 1 is a schematic representation of an exemplary system for allowing a player to play a bingo-type game, according to an embodiment of the invention.

The exemplary embodiments herein relate to matching-type games. It should be understood that each of the methods and individual steps recited herein may be partially or wholly carried out in a variety of ways and/or systems, which may include, but are not limited to, a live dealer physically dealing playing cards in a casino, a dealer providing a plurality of bingo cards that includes randomly selected bingo symbols, an electronic gaming machine (EGM) for use by one or more players, a multiplayer platform which may include a player interface such as a touchscreen display and involve physical or virtual bingo cards, a home computer and/or portable computing device, such as a tablet computer or mobile phone capable of communicating with a network or over the Internet, global telecommunication network or world wide web.

It should further be understood that the invention is directed to, among other things, methods of providing, conducting and resolving wagering games that include a sequence of controlled and concrete transformative events. Some of these events may involve wagering, the generation of random data, the application of randomly-generated data to predefined rules, the determination of wager outcomes in accordance with preset outcome determining criteria, the notification of such outcomes, awarding of payouts and collecting of wagers. The generation of random data may be facilitated by computerized and/or physical implements. The transformative events may also include parsing of the data for comparative purposes with preset criteria to determine an outcome in a second, bonus or associated wagering game.

With reference to the drawings and in operation, the invention overcomes at least some of the disadvantages of known systems by providing, among other things, systems and methods which enable a player to play a bingo-type game that includes matching player symbols and selected game symbols to form a path between an origin symbol and a destination symbol. For example, the system and methods of the invention are configured to allow a player to purchase a bingo card that includes plurality of player symbols including at least one origin symbol and at least one destination symbol, randomly select a plurality of game symbols and determine whether the selected game symbols match the player symbols, determine if the matched player symbols form a path extending between the origin symbol and the destination symbol, and responsively provide an award to the player based on the formed path. By providing an award to player based on a path formed by matched player symbols, the player's expectation of achieving a winning outcome with the purchased bingo card is increased, thus increasing the amount of bingo cards purchased by the player and increasing the amount of revenue received from the purchases.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

FIG. 1 is a schematic representation of the system 10, according to an embodiment of the invention. In the illustrated embodiment, the system 10 includes a server system 12 that is coupled to one or more user computing devices 14. Each user computing device 14 is configured to transmit and receive data to and/or from the server system 12 to display graphical interfaces 16 (shown in FIGS. 4-11) to enable a user to participate in bingo-type games via the user computing device 14. In the illustrated embodiment, the server system 12 is coupled to each user computing device 14 via a communications link 18 that enables each user computing device 14 to access server system 12 over a network 20, such as the Internet, a cellular telecommunications network 22, a wireless network and/or any suitable telecommunication network that enables the user computing devices 14 to access the server system 12. For example, in one embodiment, the user computing device 14 includes a mobile computing device 24, e.g. a smartphone 26 that communicates with the server system 12 via the cellular telecommunications network 22 and/or the Internet. In another embodiment, the user computing device 14 may include a personal computer, laptop, cell phone, tablet computer, smartphone/tablet computer hybrid, personal data assistant, and/or any suitable computing device that enables a user to connect to the server system 12 and display the graphical interfaces 16.

In the illustrated embodiment, each user computing device 14 includes a controller 28 that is coupled to a display device 30 and a user input device 32. The controller 28 receives and transmits information to and from the server system 12 and displays the graphical interface 16 (shown in FIGS. 4-11) on the display device 30 to enable the user to interact with the server system 12 to play the games in accordance with the embodiments described herein. The display device 30 includes, without limitation, a flat panel display, such as a cathode ray tube display (CRT), a liquid crystal display (LCD), a light-emitting diode display (LED), active-matrix organic light-emitting diode (AMOLED), a plasma display, and/or any suitable visual output device capable of displaying graphical data and/or text to a user. Moreover, the user input device 32 includes, without limitation, a keyboard, a keypad, a touch-sensitive screen, a scroll wheel, a pointing device, a barcode reader, a magnetic card reader, a radio frequency identification (RFID) card reader, an audio input device employing speech-recognition software, and/or any suitable device that enables a user to input data into the controller 28 and/or to retrieve data from the controller 28. Alternatively, a single component, such as a touch screen, a capacitive touch screen, and/or a touchless screen, may function as both the display device 30 and as the user input device 32.

In the illustrated embodiment, the server system 12 includes a gaming controller 34, a communications server 36, a player account server 38, a database server 40, and a database 42. The servers 36, 38, and 40, gaming controller 34, and database 42 are connected through a network 44 such as, for example, a local area network (LAN), a wide area network (WAN), dial-in-connections, cable modems, wireless modems, and/or special high-speed Integrated Services Digital Network (ISDN) lines. Moreover, at least one administrator workstation 46 is also connected to the network 44 to enable communication with the server system 12. Alternatively, the workstation 46 may be coupled to the network 44 using an Internet link or may be coupled through an intranet.

The communications server 36 communicates with the user computing devices 14 and the administrator workstation 46 to facilitate transmitting data over the network 44 via the Internet and/or the cellular network 22, respectively.

The database server 40 is connected to the database 42 to facilitate transmitting data to and from the database 42. The database 42 contains information on a variety of matters, such as, for example, account information related to a user, user profile information, a game type, a number of game symbols associated with a game, and image data for producing game images and/or screens on the user computing device 14. In one embodiment, the database 42 includes a centralized database that is stored on the server system 12 and is accessed directly via the user computing devices 14. In an alternative embodiment, the database 42 is stored remotely from the server system 12 and may be non-centralized.

The gaming controller 34 includes a processor 48 and a memory device 50 that is coupled to the processor 48. The memory device 50 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the processor 48 to store, retrieve, and/or execute instructions and/or data.

The processor 48 executes various programs, and thereby controls other components of the server system 12 and the user computing device 14 according to user instructions and data received from the user computing devices 14. The processor 48 in particular displays the graphical interfaces 16 (shown in FIGS. 4-11) and executes a game program, and thereby enables the system 10 to generate games and allow the user to play the games in response to user instructions received via the user computing devices 14 in accordance with the embodiments described herein. The memory device 50 stores programs and information used by the processor 48. Moreover, the memory device 50 stores and retrieves information in the database 42 including, but not limited to, image data for producing images and/or screens on the display device 30, and temporarily stores variables, parameters, and the like that are used by the processor 48. In addition, the memory device 50 may store a game list 52 in the database 42 that includes data related to a collection of simulated casino-type games (shown in FIGS. 5-11) that are available for play via the user computing device 14. The simulated casino-type games may include, but are not limited to, a bingo-type game, a video slot game, a keno game, a blackjack game, a video craps game, a video poker game, or any casino-type of game which allows a player to place a wager, play a game, and potentially provide the player an award. In addition, the game list 52 may include game indicia, symbol weights, paytables, and/or winning combination tables which represent relationships between combinations of random numbers, combinations of symbol matches and types of awards associated with each game.

In the illustrated embodiment, the gaming controller 34 includes multiple instances of a game such that each user computing device 14 may play a separate instance of the game simultaneously. In addition, the gaming controller 34 enables players on one or more user computing devices 14 to simultaneously play the same game.

In the illustrated embodiment, the player account server 38 stores information associated with a plurality of user profile accounts and a plurality of corresponding unique user identifiers in a user profile program 53 in the database 42. In the illustrated embodiment, the player account server 38 uses the unique user identifier to identify the user profile account associated with the unique user identifier and provide the user access to the server system 12 to imitate a gaming session via a user computing device 14. In one embodiment, the unique user identifier may include a combination of a username and password. Alternatively, in another embodiment, the unique user identifier may include a personal identification number, or a random identification number assigned to a corresponding user account. For example, in one embodiment, the unique user identifier may include a mobile device identifier, such as, for example, a cellular phone number and/or wireless internet address for identifying a user computing device 14 associated with a user account.

In one embodiment, each user profile account may include personal identification information such as, for example, a user name, address, personal identification number, date of birth, email address, mobile phone number, and/or any suitable information that enables the player account server 38 to identify a user. in addition, the user profile account may include player tracking information such as, for example, a type of game previously played by the player, a frequency in which the player plays a game, the average number of games played over a predefined period of time, the average credit wager the player makes per play of a game, a total amount wagered by the player over a predefined period of time, and/or any other suitable player tracking information. In addition, the user profile account may also include a list of preferred game categories such as, for example, type of games, amount of wagers made per game, number of games to be played simultaneously, total amount of wagers made during gaming session, and/or any information related to a preferred game environment that enables the system 10 to function as described herein.

In the illustrated embodiment, each user profile account also includes financial account information associated with each user. The financial account information may include, but is limited to, an amount of game credits available for use in playing games, available monetary funds for use in purchasing game credits, an available game credit account balance, and/or any suitable financial information that enables the system 10 to function as described herein.

In the illustrated embodiment, the workstation 46 includes a display and user input device to enable an administrative user to access the server system 12 to transmit data indicative of the game and/or awards to the database server 40. This enables an administrative user to periodically update the game list, game types, user profile accounts, and/or any suitable data and information that enables the system 10 to function as described herein.

Figure 2:
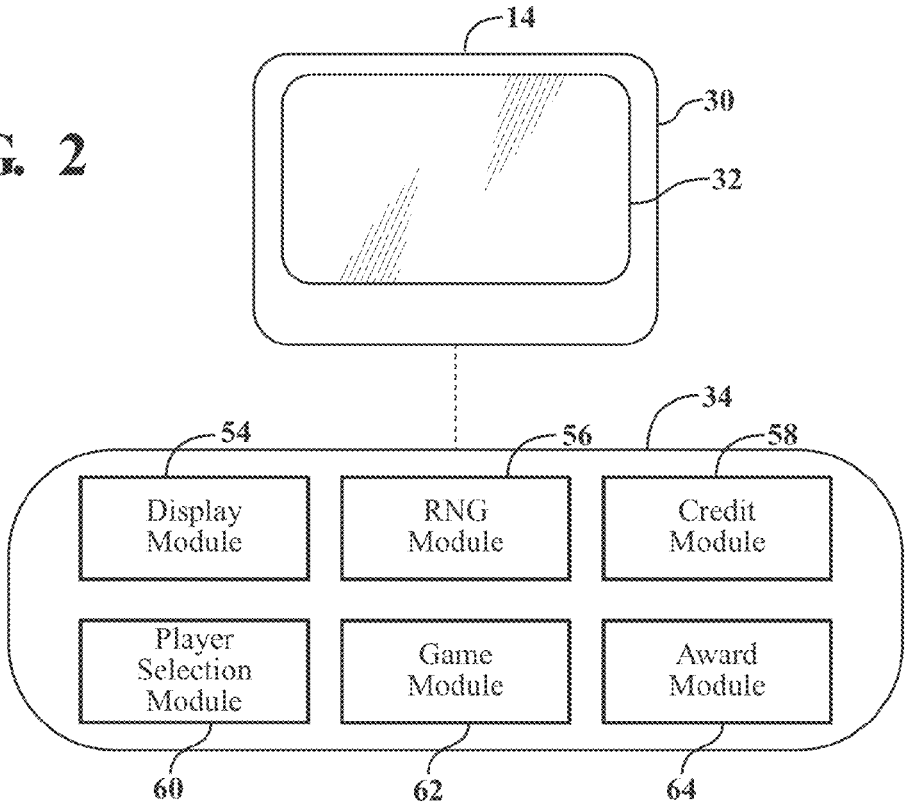
FIG. 2 is schematic view of a gaming controller that may be used with the system shown in FIG. 1.

FIG. 2 is schematic view of the gaming controller 34. In the illustrated embodiment, the gaming controller 34 includes a display module 54, a random-number generator (RNG) module 56, a credit module 58, a player selection module 60, a game module 62, and an award module 64.

The display module 54 controls the display device 30 to display various images on the graphical interface 16 preferably by using computer graphics and image data stored in the database 42. More specifically, the display module 54 controls the game symbols 66 being displayed in a game such as, for example, a bingo-type game 68 (shown in FIG. 4) on the display device 30 by using computer graphics and the image data. In the illustrated embodiment, the display module 54 also displays a plurality of user selection areas 70 (shown in FIG. 4) within the graphical interface 16 that correspond to specific operations that may be initiated by the user. For example, in the illustrated embodiment, the display module 54 displays each game symbol 66 including and associated selection area 70 to enable the user to select each displayed game symbol 66 to indicate a user's selection of the corresponding game symbol 66. Each of the selection areas 70 may receive a user selection input via the user input device 32.

The credit module 58 communicates with the player account server 38 to manage the amount of player's credits available for use in playing the bingo-type game 68. The credit module 58 receives a user selection indicative of a request from a user computing device 14 to play a game including an amount of game credits associated with the selected game. The credit module 58 sends a verification message to the player account server 38 including a unique user identifier and a game credit amount associated with the requested game play. The player account server 38 identifies the user profile account associated with the unique user identifier and determines if sufficient game credits are available in the user profile account as a function of the user request. If the player account server 38 determines sufficient game credits are available in the user profile account, the player account server 38 sends a verification message to the credit module 58 and deducts a corresponding amount of game credits from the user profile account. If the player account server 38 determines that the user profile account does not include a sufficient amount of game credits, the credit module 58 displays a message on the user computing device 14 requesting the user to purchase additional game credits corresponding to the request. In addition, the credit module 58 may also display an amount of game credits included in the user profile account that are available for use in playing and/or wagering on the games.

The game module 62 includes a game program for use in playing a game based on user selection input receive from a user computing device 14. The game module 62 receives game information from the game list 52 included in the database 42 and performs various functions and calculations to play the game according to a set of predetermined game rules and player input. More specifically, the game module 62 retrieves game elements from the database 42, and causes the display module 54 to display the game on the display device 30. The game module 62 receives signals indicative of s user selection input via the user input device 32 and generates an outcome of the game based on the predetermined game rules and the received user selection input, and displays the game outcome on the display device 30.

The RNG module 56 generates and outputs random numbers to the game module 62 for use in playing the game 68. In addition, the game module 62 may use random numbers generated by the RNG module 56 to determine if a winning condition has occurred in the outcome of the game, and to determine whether or not to provide an award to a player. For example, if the game is the bingo-type game 68, the game module 62 uses the RNG module 56 to randomly select one or more bingo cards 72 (shown in FIGS. 4 and 5) including a plurality of player symbols 74 and/or bingo numbers for use during the bingo-type game 68. In addition, the game module 62 uses the RNG module 56 to randomly select a plurality of game symbols 66 during a symbol draw. The game module 62 compares the game symbols 66 selected during the draw with the player symbols 74 and/or numbers displayed in the selected bingo cards 72 to determine a number of player symbols 74 and/or numbers matching the randomly selected game symbols 66.

In the illustrated embodiment, the player selection module 60 receives a user selection input from the input device 32, selects player symbols 74 based on the player's selection, and displays a notification indicative of the player's selection on the graphical interface 16. In addition, the player selection module 60 transmits the player's selection to the game module 62 for use in determining if a player's symbol selection matches a selected game symbol 66. In one embodiment, the player selection module 60 may receive the selected game symbol 66 from the game module 62 and select the corresponding player symbol 74 without input from the user.

In the illustrated embodiment, the game module 62 determines an outcome of the bingo-type game 68 including any determined symbol matches and transmits the game outcome to the award module 64. The award module 64 compares the game outcome with winning combinations stored in a winning combination table to determine if the symbol matches include a winning outcome that is associated with a type of award. In addition, the award module 64 may determine if a triggering condition occurred in the bingo-type game and provides an additional award such as, for example, a bonus feature game and/or an enhanced award based on the triggering condition.

Figure 3:
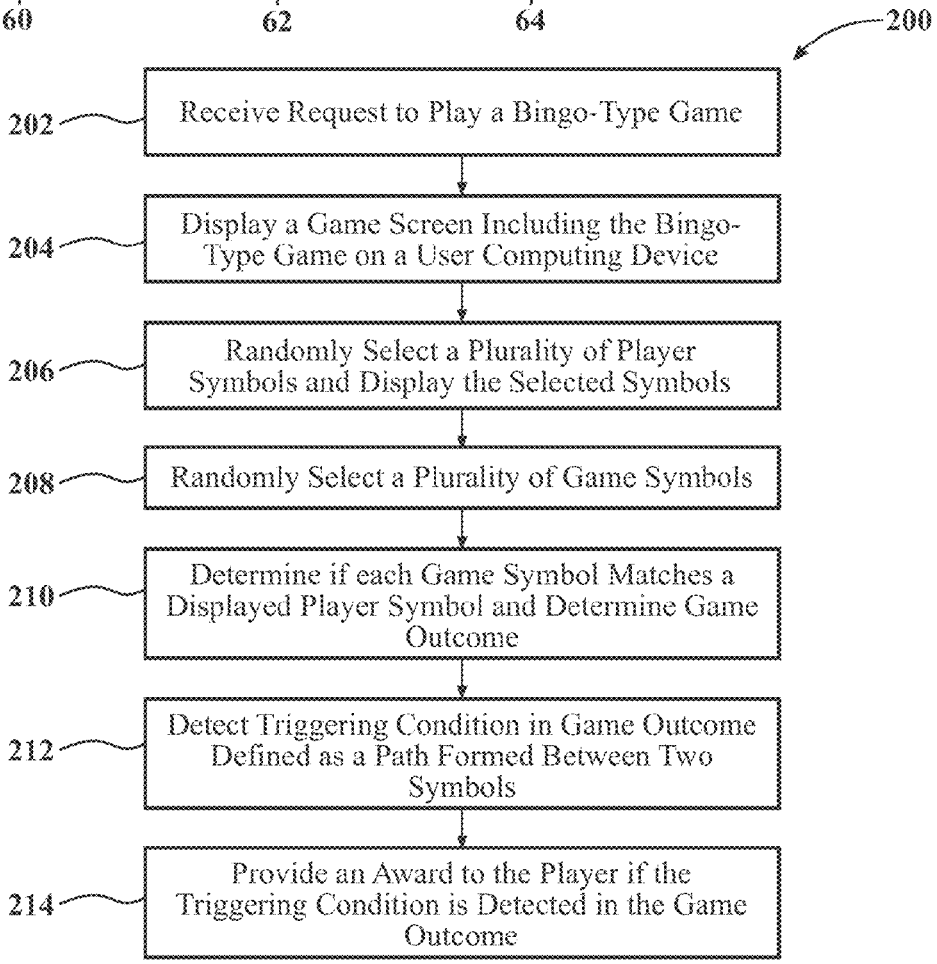
FIG. 3 is a flowchart of a method that may be used with the system shown in FIG. 1 for allowing a player to play a game via a user computing device, according to an embodiment of the invention.
Figure 4:
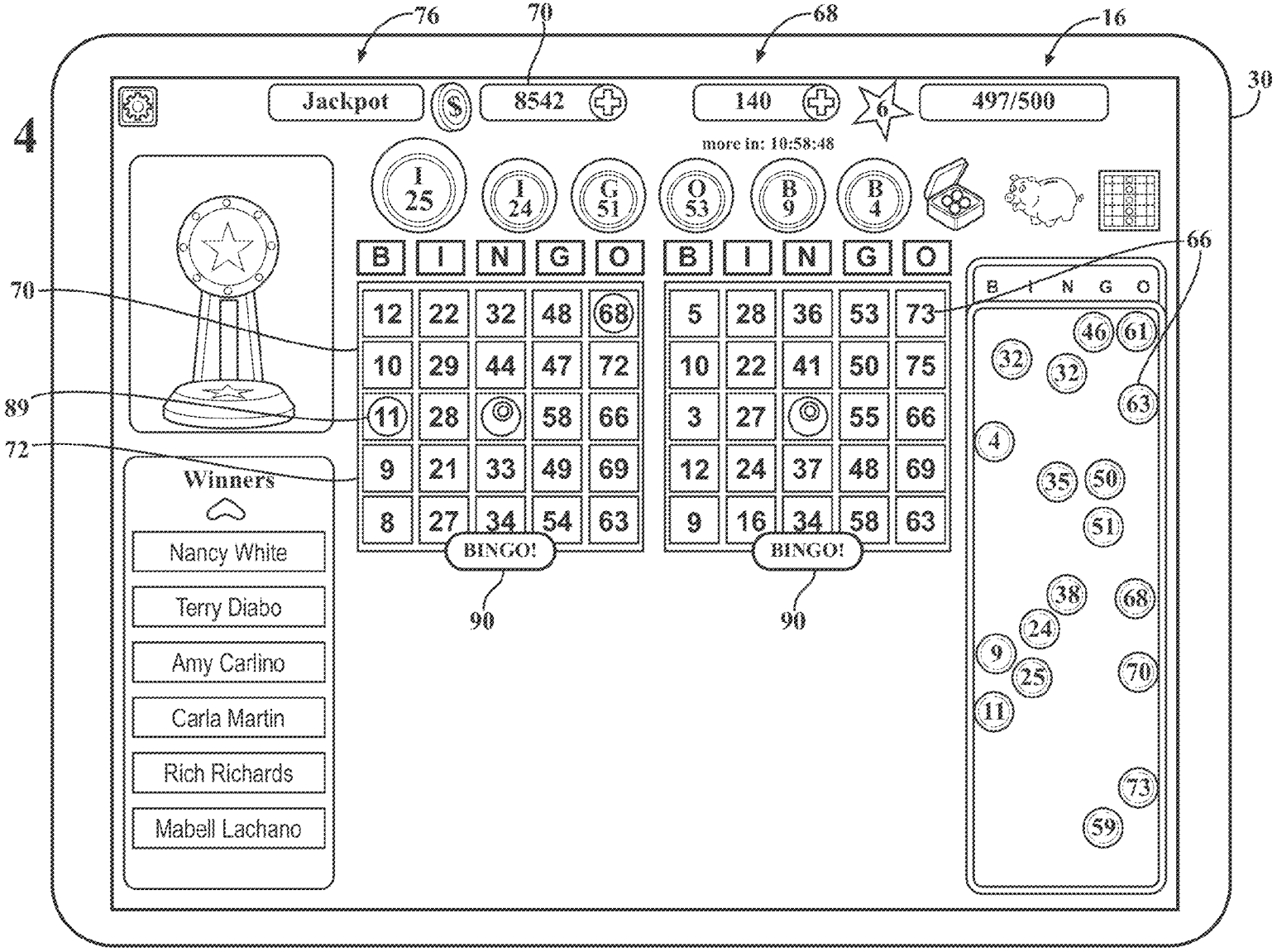
FIG. 4 is an exemplary entertaining graphical display of a bingo-type game that may be used with the method shown in FIG. 3, according to an embodiment of the present invention.
Figure 5:
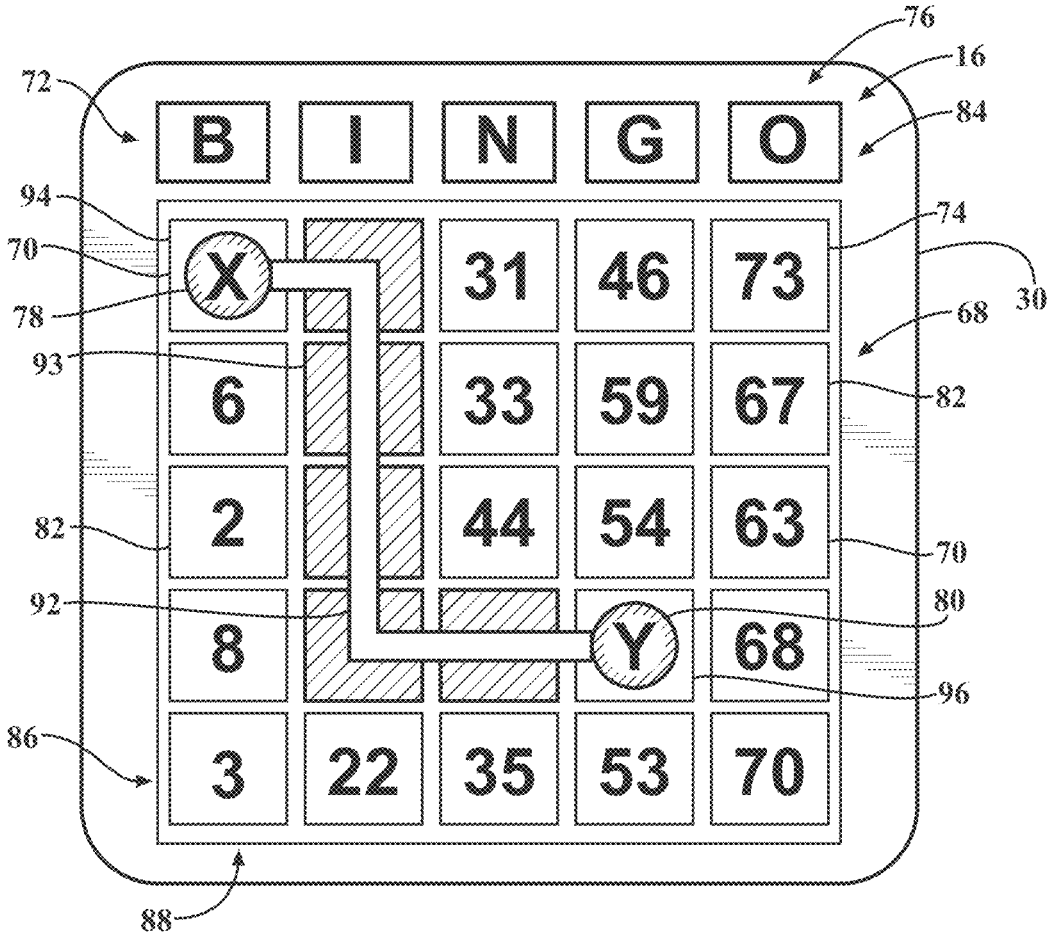
FIG. 5 is another exemplary entertaining graphical display of a bingo-type game that may be used with the method shown in FIG. 3, according to an embodiment of the present invention.
Figure 6:
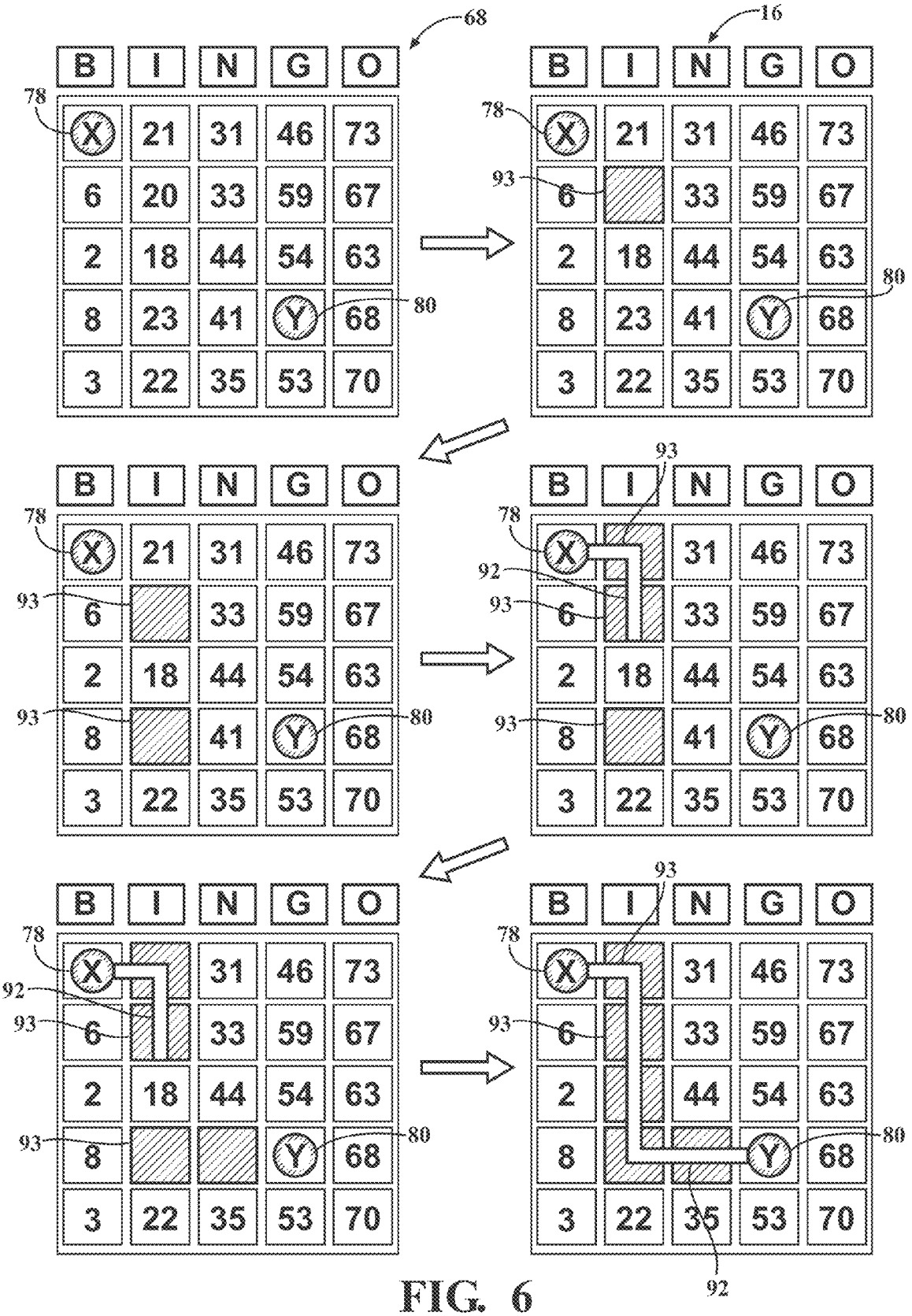
FIG. 6 is series of graphical displays of the bingo-type game shown in FIG. 5 that may be used with the method shown in FIG. 3.

FIG. 3 is a flowchart of a method 200 that may be used with the system 10 for allowing a player to play a game via a user computing device 14. Each method step may be performed independently of, or in combination with, other method steps. Portions of the method 200 may be performed by any one of, or any combination of, the components of the system 10. FIGS. 4 and 5 are exemplary entertaining graphical displays of the bingo-type game 68 that may be played with the system 10. FIG. 6 is series of graphical displays of the bingo-type game 68 that may be played with the system 10. FIGS. 7-11 are graphical displays of bingo-type games 68 that may be played with the system 10. In the illustrated embodiment, entertaining graphical displays for amusement purposes are presented by the user computing device 14 via the display device 30 (shown in FIG. 1) and may receive input (e.g., selections and/or entries) via the user input device 32 (shown in FIG. 1). For example, in one embodiment, a selection may be received via user input device 32 of the user computing device 14 and may be transmitted by the user computing device 14 to the server system 12 via the network 20.

In the illustrated embodiment, in the method step 202, the gaming controller 34 receives a request from a player to play the bingo-type game 68 from a user computing device 14. In one embodiment, the player may submit the request by accessing a website via the communications server 36. In another embodiment, the player may access a mobile website via the cellular network 22. In addition, in one embodiment, the method step 202 may include receiving, by the gaming controller 34, a unique user identifier to validate the request to display the bingo-type game 68. More specifically, the display module 54 may display a login screen (not shown) on the user computing device 14 to request the unique user identifier such as, for example requesting a username and/or password. The gaming controller 34 receives the unique user identifier and transmits a validation request including the user credentials to the player account server 38. The player account server 38 compares the received unique user identifier with the collection of unique user identifier contained in the user profile program to validate the unique user identifier and responsively sends a validation message to the gaming controller 34 if the received unique user identifier is included in the user profile program. Upon receiving the validation message from the player account server 38 the gaming controller 34 displays a listing of available games from the game list 52. In addition, in one embodiment, if the received user identifier is not included in the user profile program, the gaming controller 34 may prompt the user to establish a user account and/or display the available games without requiring the user to establish a user account and/or verify a user account. In addition, in one embodiment, method step 202 may also include receiving a wager from the player and/or receiving a request to purchase a play of the game with game credits from the corresponding user profile account.

In method step 204, the gaming controller 34 displays a game screen 76 including a game in response to the request received from the player via the user computing device 14. In the illustrated embodiment, the gaming controller 34 displays the bingo-type game 68. However, it should be noted that the gaming controller 34 may display any type of game included in the game list 52 and upon which a player could make a wager and/or purchase a game play including, but not limited to a slot game, a blackjack game, a video poker game, or any type of game that enables the system 10 to function as described herein. In general, during method step 204, the game module 62 displays the bingo-type game 68 game including one or more bingo cards 72. Each bingo card 72 includes a plurality of player symbols 74 selected from a predefined set of game symbols 66. In one embodiment, the plurality of game symbols 66 may include numbers and/or a combination of letters and numbers. Alternatively, the plurality of game symbols 66 may include any symbol that may be selected from a predefined set of associated symbols.

In one embodiment, the game module 62 may display the game 68 including a plurality of bingo cards 72 determined as a function of the player's wager and/or a number of game plays purchased by the player using game credits. For example, in one embodiment, the game module 62 receives a wager from the player and receives a player selection input indicative of a number of bingo cards 72 to be purchased with the wager for use in the bingo-type game 68, and displays the selected number of bingo cards 72.

In method step 206, the game module 62 randomly selects a plurality of player symbols 74 from the predefined set of game symbols 66 and displays the selected player symbols 74 on the bingo card 72. In the illustrated embodiment, the game module 62 displays at least one bingo card 72 with a plurality of player symbols 74 including at least one origin symbol 78 and at least one destination symbol 80. Each player symbol 74 is displayed in a corresponding symbol position 82 that is displayed in a grid 84 and arranged along a plurality of rows 86 and a plurality of columns 88. In the illustrated embodiment, the bingo card 72 displays a total of 25 player symbols 74 displayed within the grid 84 arranged in 5 rows 86 and 5 columns 88 in a "5×5" arrangement. Alternatively, any number of player symbols 74 may be displayed in any suitable grid arrangement including, for example, 20 player symbols 74 displayed in a 4×5 arrangement, 9 player symbols 74 displayed in a 3×3 arrangement, and/or any suitable number of player symbols 74 displayed in any suitable row 86 and column 88 combination to enable the gaming controller 34 to function as described herein. In addition, the grid 84 may be displayed with a plurality of shapes such as, for example, a rectangle, a square, a diamond, a circle, and/or any suitable shape that enables the gaming controller 34 to function as described herein.

In method step 208, the game module 62 randomly selects a plurality of game symbols 66 from the predefined set of game symbols 66 and displays each selected game symbol 66 in the game screen 76.

In method step 210, the game module 62 determines if each of the selected game symbols 66 matches a corresponding player symbol 74 displayed on the bingo card 72 and determines an outcome of the bingo-type game 68 as a function of the matched player symbols 74. In the illustrated embodiment, the game module 62 plays the bingo-type game 68 in a conventional manner. The player makes a wager, which may be based on a predetermined denomination and a selected number of bingo cards 72 to be selected by the player and/or a selected number of game symbols 66, and initiates a symbol draw operation. During the symbol draw operation, the game module 62 randomly selects a plurality of game symbols 66 from the predefined set of game symbols 66 and sequentially displays each selected game symbol 66 on the display device 30. In one embodiment, the game module 62 may compare the player symbols 74 displayed on each selected bingo card 72 with each drawn game symbol 66, and identify (shown as a "circle" symbol 89 in FIG. 4) each player symbol 74 that matches the drawn game symbol 66. In another embodiment, the player may identify the matched player symbol 74 by transmitting a user selection input via a selection area 70 corresponding to the selected player symbol 74.

The game module 62 determines an outcome of the game 68 based on the matched player symbols 74 and provides an award to the player based on the matched player symbols 74, the wager, and a predetermined paytable. For example, the game module 62 may provide an award to the player based on a predefined pattern formed by the matched player symbols 74 on a bingo card 72 and/or a predefined number of matched player symbols 74 on one or more bingo cards 72. Moreover, the game module 62 may also determine a type of game symbol 66 that is matched with a player symbol 74 and provide an award if the matched symbol types are associated with a predefined symbol type. In general, the term "award" may be a payout, in terms of credits or money. Thus, the gaming controller 34 may award a regular payout in response to the outcome of the bingo-type game 68. However, it should be noted that the term award may also refer to other types of awards, including, prizes, e.g., meals, show tickets, etc. . . . , as well as in-game award, such as free games, bonus symbols, and/or special game modes.

In one embodiment, the game module 62 may determine a number of players to be included in a round of the bingo-type game 68 and determine a number of awards that are available during the round based on the number of player's participating in the game round. For example, the game module 62 may determine a predefined number of players required to play a round of the game and/or a predefined number of bingo cards to be included in a game round. The game module 62 may also initiate game play when the a number of requests to play the game and/or the number of bingo cards issued is equal to the predefined number of player's and/or the predefined number of bingo cards, respectively. In addition, the game module 62 may also determine a number of awards based on the number of players participating in the game round and/or the number of bingo cards issued during the game round. During play of the game, the game module 62 may determine the outcome of each bingo card 72 and terminate the game round when the determined number of awards has been awarded during the round.

In one embodiment, the game module 62 may also require each player to select the matched player symbols 74 during play of the game and require the player to indicate that the corresponding bingo card 72 includes a winning outcome by selecting a "BINGO!" selection area 90 displayed with each bingo card 72. In another embodiment, during game play, the game module 62 may also determine if a bingo card 72 includes a winning outcome and prompt the player to select the "BINGO!" selection area 90 before providing an award to the player. In this manner, the gaming controller 34 may provide an award to the player only if the player selects the "BINGO!" selection area 90 and the corresponding bingo card 72 includes a winning outcome. In one embodiment, during a round of a game, the game module 62 may determine that the number of players having winning outcomes, for example winning bingo cards, is greater than the number of awards to be provided during the round. The game module 62 may determine which players may receive an award by detecting a number of players who indicate a winning outcome prior to the next drawn game symbol 66 being displayed, and provide an award to each player that has indicated a winning outcome before the next game symbol 66 is drawn. In addition, the game module 62 may detect a period of time from the display of the previous drawn game symbol 66 at which each player has indicated a winning outcome prior to the draw of the next game symbol 62, and provide the awards to the players in chronological order based on the time at which each player indicated a wining outcome. The player may indicate a winning outcome by selecting the "BINGO!" selection area 90 upon achieving a winning bingo card outcome. Many variations to the above described general play of a bingo-type game fall within the scope of the present invention.

In method step 212, the game module 62 determines if a triggering condition occurs in the outcome of the bingo-type game 68. In method step 214, the award module 64 provides an award to the player based on the triggering condition occurring in the game outcome. In the illustrated embodiment, the game module 62 defines the triggering condition as a path 92 being formed on the bingo card 72 that extends between the origin symbol 78 and the destination symbol 80 and that includes at least one matched player symbol 74. For example, as shown in FIG. 5, the game module 62 may determine the triggering condition to have occurred during game play when the path 92 is formed by a plurality of matched player symbols 74 that extend from the origin symbol 78 to the destination symbol 80. In one embodiment, the game module 62 may randomly select the origin symbol 78 from the plurality of player symbols 74 displayed in the bingo card 72. In addition, the game module 62 may also randomly select the destination symbol 80 from the plurality of player symbols 74 displayed in the bingo card 72.

Referring to FIGS. 4-6, in the illustrated embodiment, during play of the bingo-type game 68, the game module 62 randomly selects game symbols 66 from the predefined set of game symbols 66 and displays the game symbols 66 within the game screen 76. The game module 62 also receives a player's selection of a player symbol 74 displayed on a corresponding bingo card 72, determines if the player's selected player symbol 74 matches a selected game symbol 66 and identifies (shown as a "shaded" symbol 93 in FIGS. 5 and 6) the selected player symbol 74 on the bingo card 72. During play of the game 68, as adjacent matched player symbols 74 are displayed on the bingo card 72, the game module 62 displays a portion of the path 92 extending from the origin symbol 78 towards the destination symbol 80. In addition, if adjacent matched player symbols 74 form a complete path 92 from the origin symbol 78 to the destination symbol 80, the game module 62 displays the completed path 92 on the bingo card 72 and moves the origin symbol 78 along the path 92 and to the destination symbol 80 to notify the player of the occurrence of the triggering condition in the game outcome.

Moreover, in one embodiment, the game module 62 may be configured to display a notification to the player indicative of the completed path 92 and detect the triggering condition upon receiving a user selection input corresponding to the completed path 92. For example, similar to the player's selection of the "BINGO" selection area 90 to acknowledge a winning outcome, the display module 54 may display a selection area 70 associated with the path and the game module 62 may detect the triggering condition only if the player selects the path selection area 70.

In another embodiment, the game module 62 may be configured to determine if the origin symbol 78 matches one of the selected game symbols 66 and determine the triggering condition to occur if the origin symbol 78 is a matched symbol. In addition, the game module 62 may determine if the destination symbol 80 matches one of the selected game symbols 66 and determine the triggering condition to occur if the destination symbol 80 is a matched symbol. In another embodiment, the game module 62 may determine the triggering condition to occur if both the origin symbol 78 and the destination symbol 80 match a corresponding selected game symbol 66.

The game module 62 may also be configured to determine if the path 92 matches a predefined path between the origin symbol 78 and the destination symbol 80 and detect the triggering condition if the path 92 matches the predefined path. For example, in one embodiment, the game module 62 may randomly select a predefined path from a plurality of predefined paths stored in the database 42 and display the predefined path on the bingo card 72. The game module 62 may also detect the triggering condition if a plurality of adjacent matched player symbols 74 extend along the selected predefined path between the origin symbol 78 and the destination symbol 80.

In one embodiment, the game module 62 may be configured to select an origin symbol position 94 from the plurality of symbol positions 82 displayed on the bingo card 72, randomly select a player symbol 74 being displayed in the origin symbol position 94 and define the player symbol 74 being displayed in the origin symbol position 94 as the origin symbol 78. In addition, the game module 62 may detect the triggering condition if the origin symbol 78 is a matched symbol and the path 92 is formed between the matched origin symbol 78 and the destination symbol 80. In addition, in one embodiment, the game module 62 may randomly select a destination symbol position 96 from the plurality of symbol positions 82 displayed on the bingo card 72 and define the player symbol 74 being displayed in the selected destination symbol position 96 as the destination symbol 80. Moreover, the game module 62 may detect the triggering condition if the destination symbol 80 is a matched symbol and the path 92 extends from the origin symbol 78 to the destination symbol 80.

Figure 7:
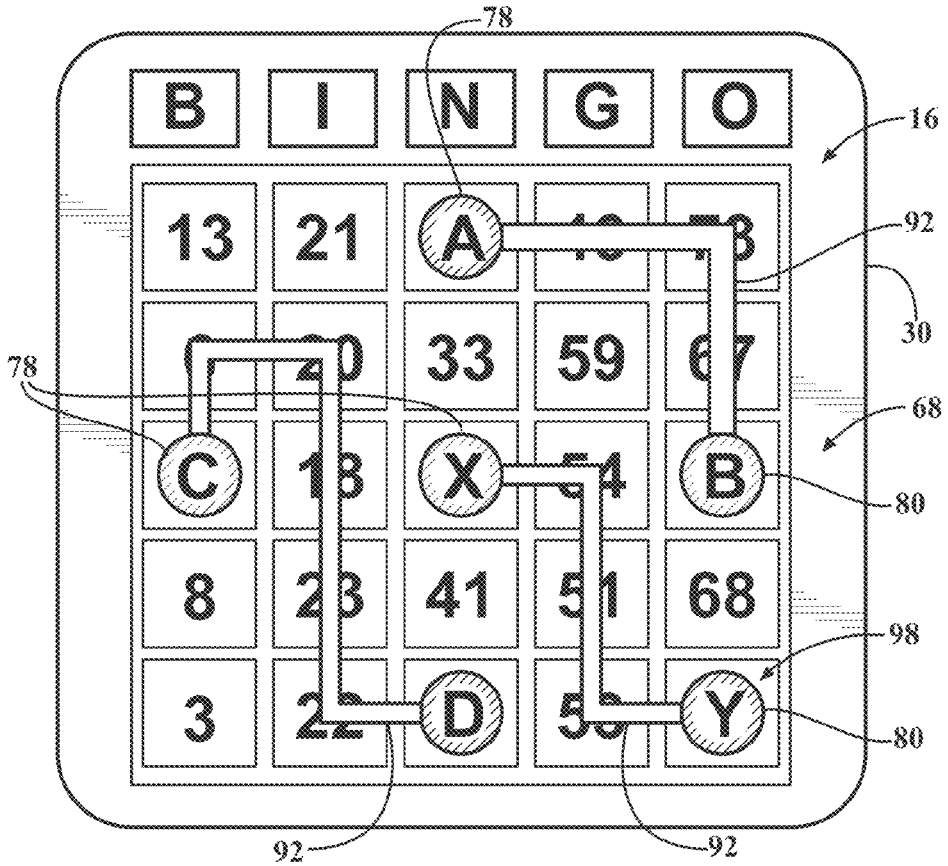
FIGS. 7-11 are graphical displays of bingo-type games that may be used with the method shown in FIG. 3.

Referring to FIG. 7, in one embodiment, the game module 62 may display the bingo-type game 68 including a plurality of origin symbols 78 and a plurality of destination symbols 80. The game module 62 may also define the triggering condition as including at least one path 92 extending between one of the plurality of origin symbols 78 and one of the plurality of destination symbols 80. In addition, in another embodiment, the game module 62 may display the bingo-type game 68 including a plurality of origin-destination symbol pairs 98. Each origin-destination symbol pair 98 includes an origin symbol 78 and a corresponding destination symbol 80. The game module 62 may define the triggering condition to include at least one path 92 extending between corresponding origin and destination symbols 78 and 80 of at least one origin-destination symbol pair 98.

Figure 8:
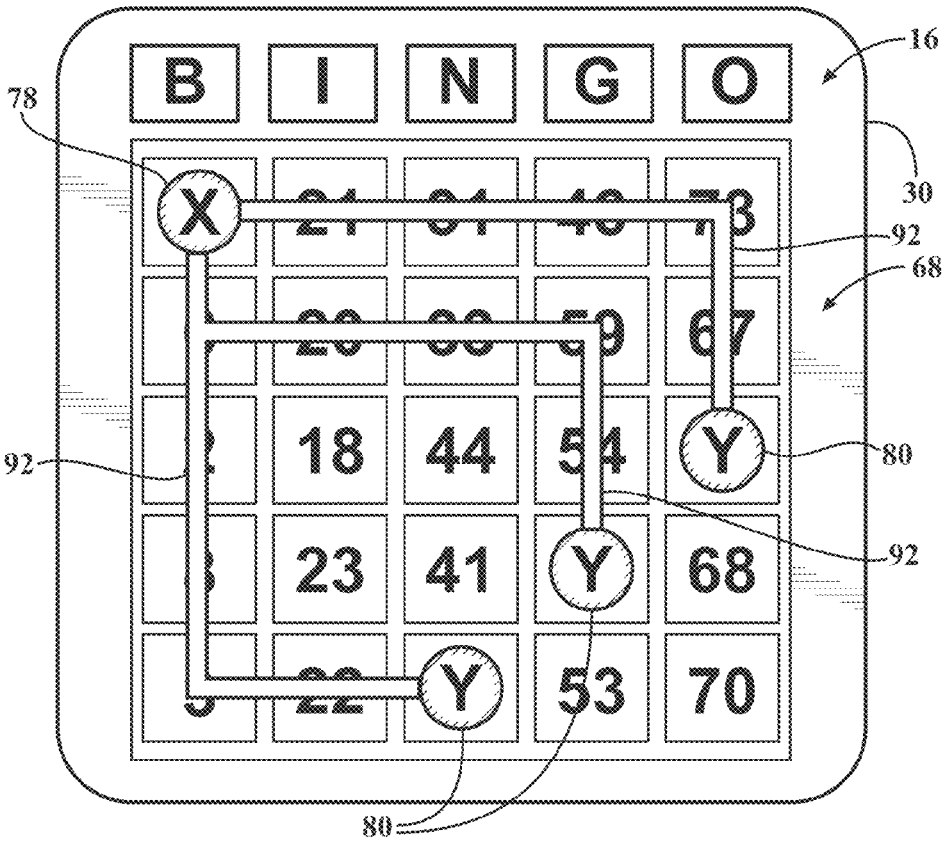
Figure 9:
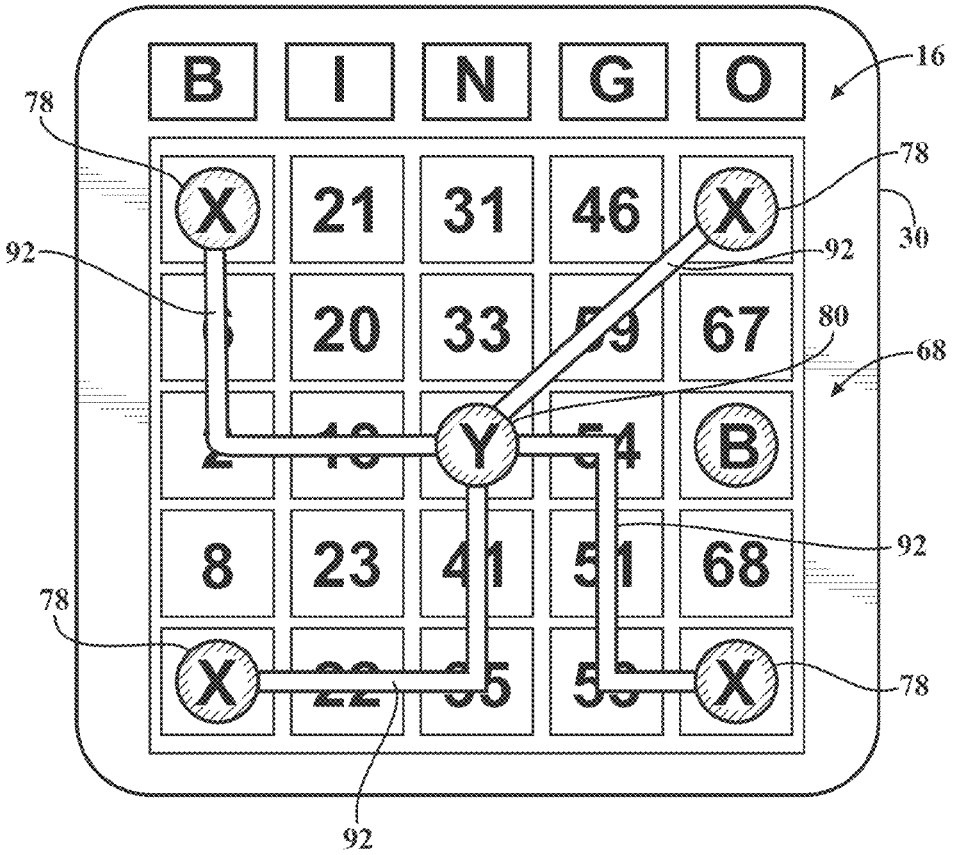

Referring to FIG. 8, in one embodiment, the game module 62 may display the bingo-type game 68 including a plurality of destination symbols 80 being displayed on the bingo card 72 and detect the triggering condition if the path 92 extends between the origin symbol 78 and one of destination symbols 80. In another embodiment, the game module 62 may detect the triggering condition if a plurality of paths 92 are formed between the origin symbol 78 and each of the destination symbols 80. Similarly, referring to FIG. 9, in one embodiment, the game module 62 may display the bingo-type game 68 including a plurality of origin symbols 78 being displayed on the bingo card 72 and detect the triggering condition if a path 92 extends between the origin symbol 78 and one of destination symbols 80, or if a plurality of paths 92 are formed between the origin symbol 78 and each of the destination symbols 80.

Figure 10:
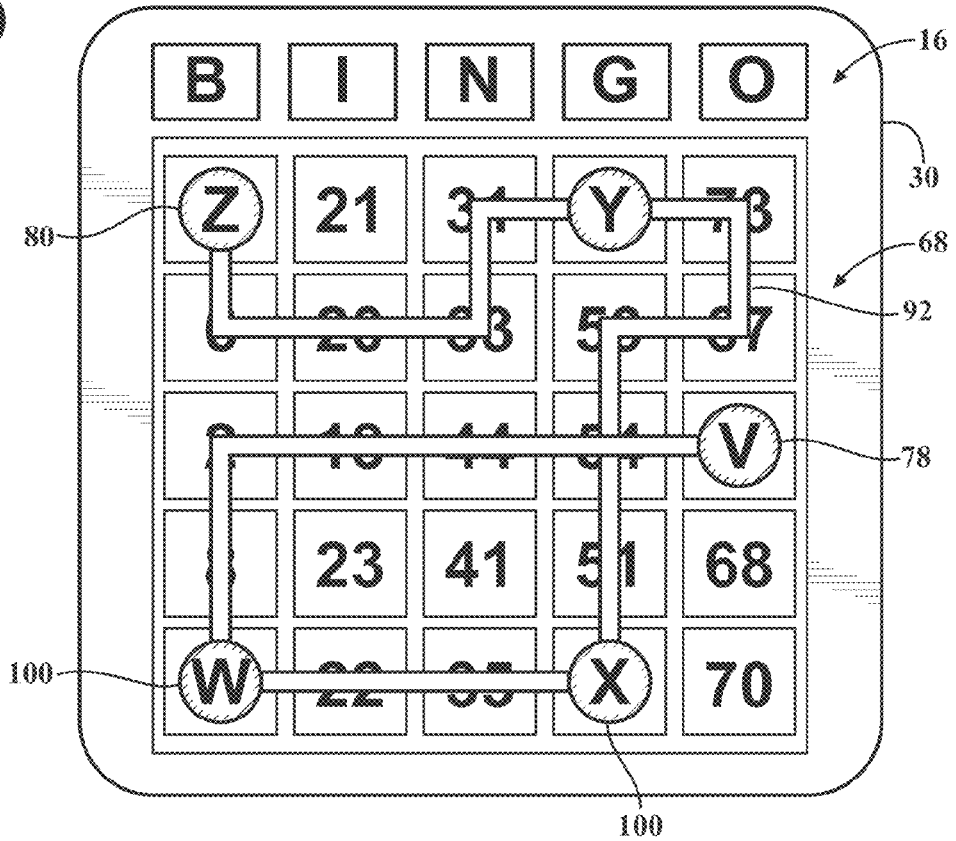

Referring to FIG. 10, the game module 62 may display a plurality of intermediate symbols 100 on the bingo card 72 and detect the triggering condition if the path 92 is formed from the origin symbol 78 to the destination symbol 80 and through each intermediate destination symbol 80 such that the origin symbol 78, the intermediate symbols 100, and the destination symbol 80 are connected by a continuous path 92. Many variations to the above described triggering condition including the path 92 formed between the origin symbol 78 and the destination symbol 80 fall within the scope of the present invention.

In another embodiment, the game module 62 may detect the triggering condition if a player symbol 74 matches a selected game symbol 66 and select another player symbol 74 as a special symbol 102. During game play, the game module 62 determines the special symbol 102 as a matched player symbol 74 in the game outcome and displays the special symbol 102 on the bingo card 72. The game module 62 may detect the triggering condition if the bingo card 72 includes three or more matched player symbols 74 and/or the game module 62 receives a user selection input indicative of more than one matched player symbol 74.

Figure 11:
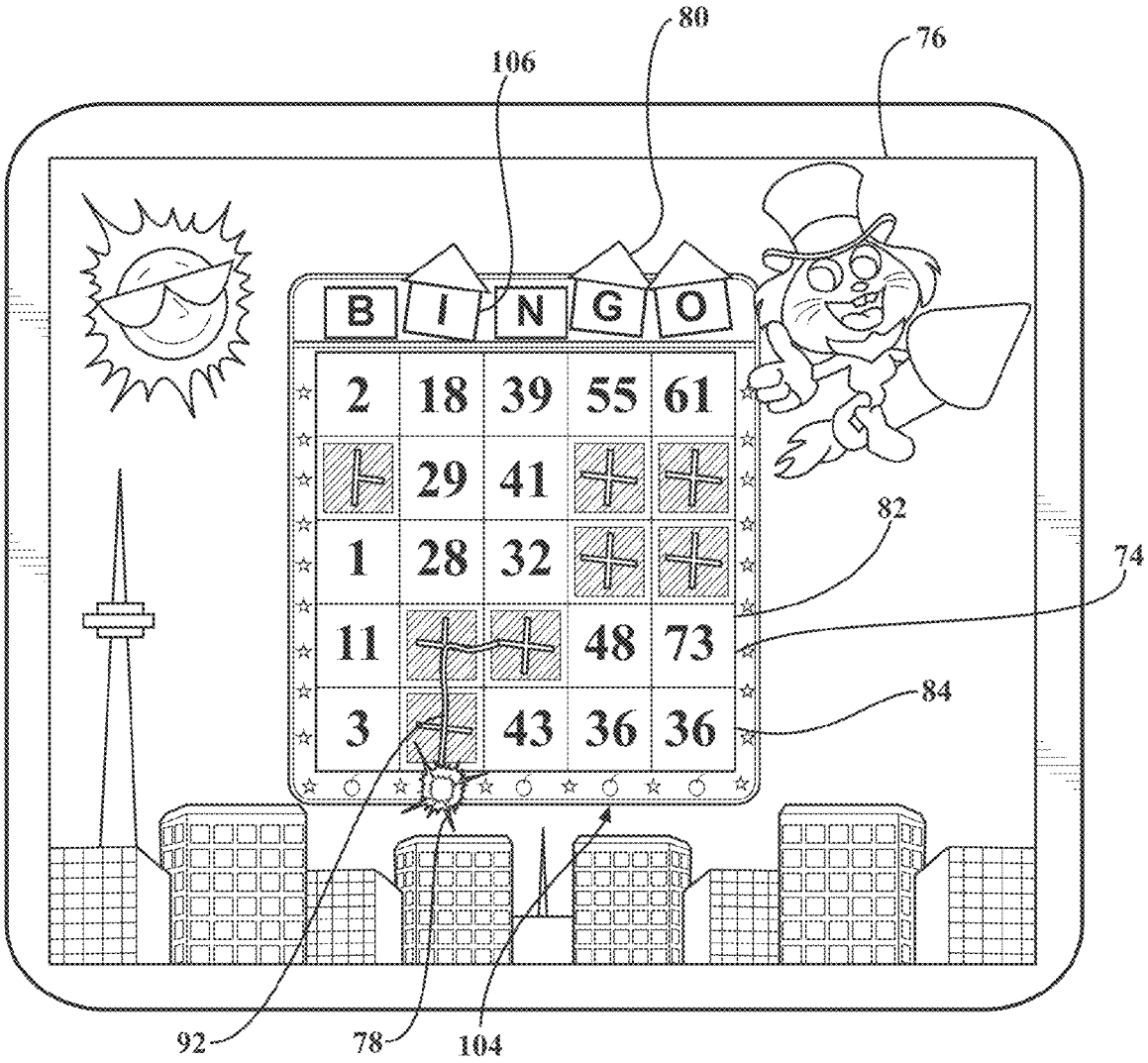

Referring to FIG. 11, in one embodiment, each player symbol 74 is displayed in the corresponding symbol position 82 that is displayed in the grid 84 within a display area 104 in the game screen 76. The game module 62 may display the origin symbol 78 and/or the destination symbol 80 in an area outside of the display grid 84. For example, the game module 62 may display the letters 106 "B", "I", "N", "G", and "O" corresponding to each column 88 and displayed outside the grid 84. The game module 62 may also select one or more of the letters 106 as the destination symbol 80 and may display the origin symbol 78 in the area outside the grid 84 such that the path 92 is defined between an origin symbol 78 and a destination symbol 80 that are each displayed outside the display grid 84. In addition, the game module 62 may also display the origin symbol 78 and/or the destination symbol 80 outside the display grid 84.

Figure 12:
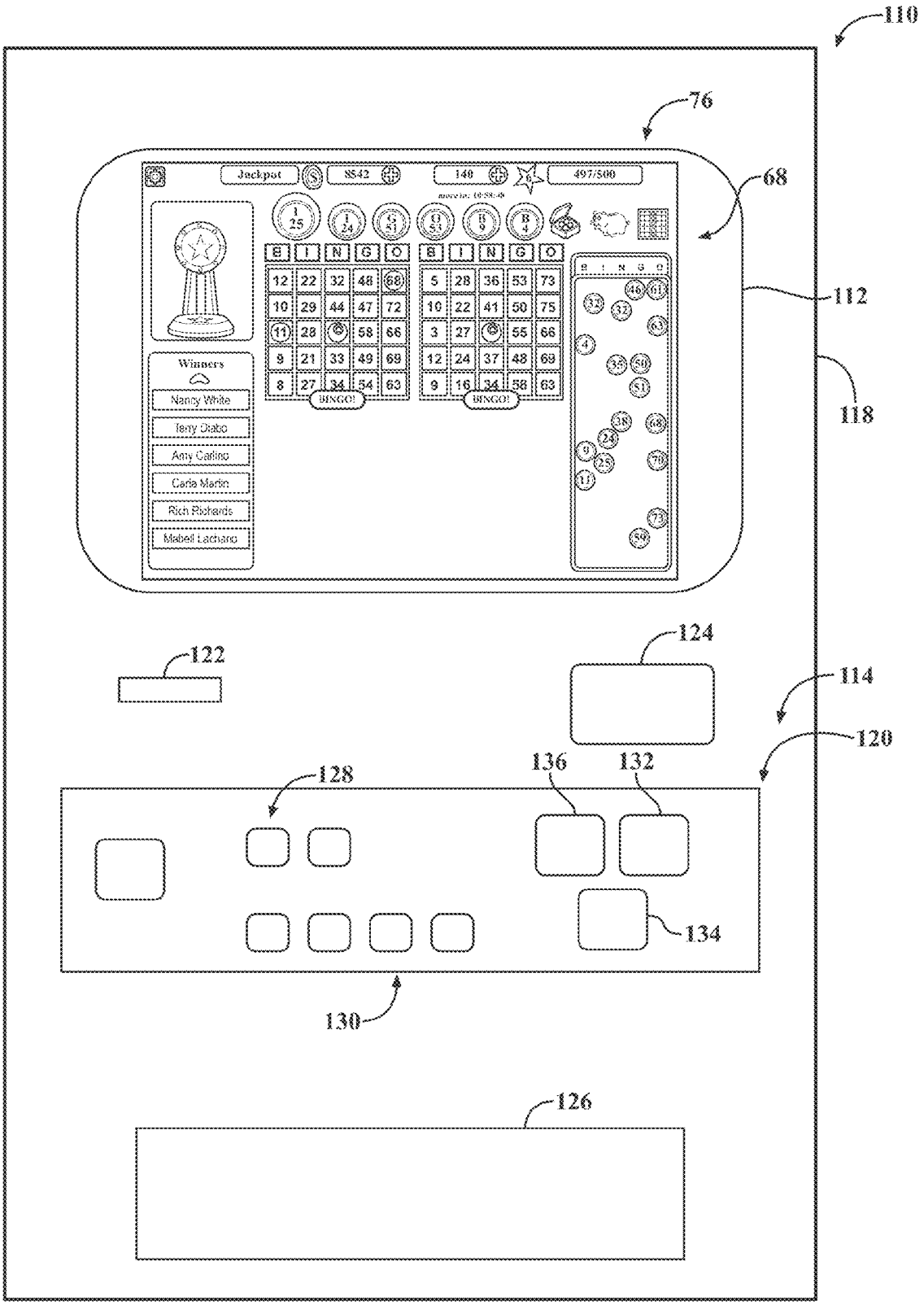
FIG. 12 is a schematic representation of a gaming machine for allowing a player to play a bingo-type game, according to an embodiment of the invention.
Figure 13:
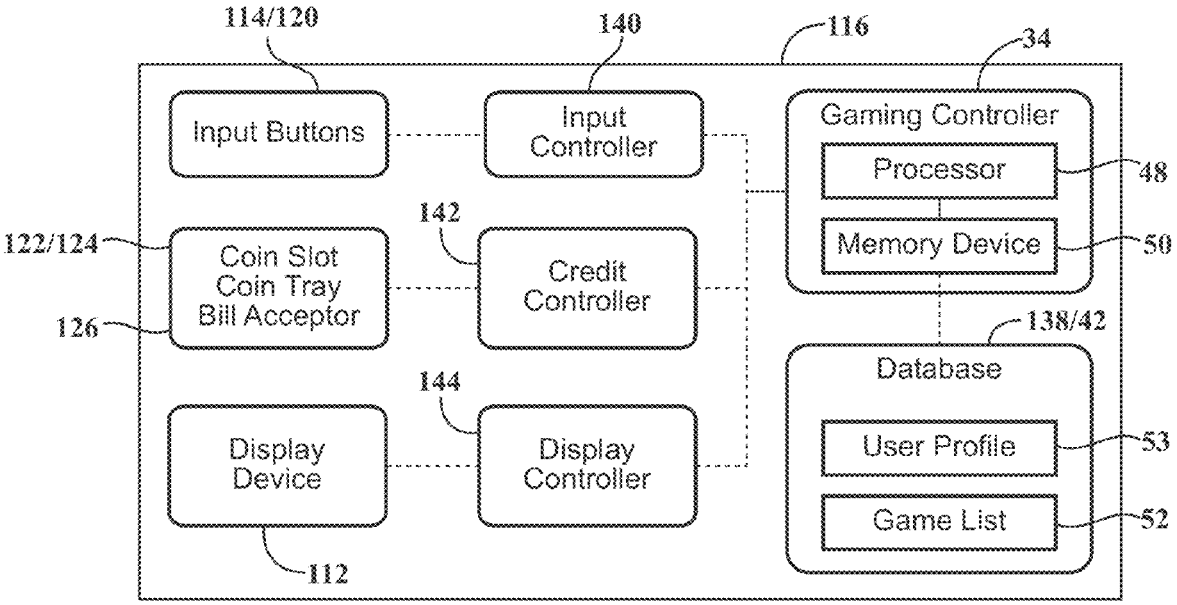
FIG. 13 is another schematic view of the gaming machine shown in FIG. 11.

FIG. 12 is a schematic representation of a gaming machine 110 that may be used with the system 10 to allow a player to play the bingo-type game 68, according to an embodiment of the present invention. FIG. 13 is another schematic view of the gaming machine 110. A preferred embodiment of the present invention is a video gaming machine preferably installed in a casino. In the illustrated embodiment, the gaming machine 110 includes a display device 112 such as, for example display device 30 for displaying a plurality of games, a user input device 114 to enable a player to interface with the gaming machine 110, and a system controller 116 that is operatively coupled to the display device 112 and the user input device 114 to enable a player to play games displayed on the display device 112. The gaming machine 110 may also include a cabinet assembly 118 that is configured to support the display device 112, the user input device 114, and/or the system controller 116 from a supporting surface.

The display device 112 and the user input device 114 are coupled to the cabinet assembly 118 and are accessible by the player. In one embodiment, the system controller 116 is positioned within the cabinet assembly 118. Alternatively, the system controller 116 may be separated from the cabinet assembly 118, and connected to components of the gaming machine 110 through a network such as, for example, a local area network (LAN), a wide area network (WAN), dial-in-connections, cable modems, wireless modems, and/or special high-speed Integrated Services Digital Network (ISDN) lines.

In the illustrated embodiment, the display device 112 displays the game screen 76 (shown in FIGS. 4 and 5) including indicia and/or symbols for use in a game, e.g., symbols for a bingo game, cards used by a card game, roulette wheel and symbols used in a roulette game, and/or reels used in a reel game.

The user input device 114 includes a plurality of input buttons 120, a coin slot 122, a bill acceptor 124, and a coin tray 126 for dispensing coins to the player. In one embodiment, the input buttons 120 may include a plurality of BET switches 128 for inputting a wager on a game and selecting a number of rounds to be played during a gaming session, a plurality of selection switches 130 for allowing a player to select a plurality of game symbols, a CLEAR switch 132 for de-selecting player selected game symbols, a PAYOUT switch 134 for ending a gaming session and dispensing accumulated gaming credits to the player, and a start button, i.e., a DRAW switch 136 to initiate an output of a game. In addition, the user input device 114 may include, for example, a keyboard, a pointing device, a mouse, a stylus, a touch sensitive panel (e.g., a touch pad or a touch screen), a gyroscope, an accelerometer, a position detector, an audio input device, and/or any suitable input device that enables the player to interact with the gaming machine 110.

The coin slot 122 includes an opening that is configured to receive coins and/or tokens deposited by the player into the gaming machine 110. The gaming machine 110 converts a value of the coins and/or tokens to a corresponding amount of gaming credits that are used by the player to wager on games played on the gaming machine 110. The bill acceptor 124 includes an input and output device that is configured to accept a bill, a ticket, and/or a cash card into the gaming machine 110 to enable an amount of gaming credits associated with a monetary value of the bills, ticket, and/or cash card to be credited to the gaming machine 110.

Referring to FIG. 13, in the illustrated embodiment, the system controller 116 includes the gaming controller 34, a database 138, an input controller 140, a credit controller 142, and a display controller 144. The gaming controller 34 communicates to the database 138, the input controller 140, the credit controller 142, and the display controller 144, and executes various programs, and thereby controls other components of the gaming machine 110 according to player instructions and data accepted by the user input device 114. The gaming controller 34 in particular executes a game program to implement the method 200 and thereby conducts a game in accordance with the embodiments described herein. In one embodiment, the gaming controller 34 utilizes RAM to temporarily store programs and data necessary for the progress of the game, and EPROM to store, in advance, programs and data for controlling basic operation of the gaming machine 110, such as the booting operation thereof.

The credit controller 142 manages the amount of player's credits, which is equivalent to the amount of coins and bills counted and validated by the bill acceptor 124. The credit controller 142 converts a player's credits to coins, bills, or other monetary data by using the coin tray 126 and/or for use in dispensing a credit voucher via the bill acceptor 124.

The input controller 140 is coupled to the user input device 114 to monitor player selections received through the input buttons 120, and accept various instructions and data that a player enters through the input buttons 120.

The display controller 144 controls the display device 112 to display various images on screens preferably by using computer graphics and image data stored in the database 138. More specifically, the display module 54 controls the game symbols displayed in the game such as, for example, a bingo-type game 68 displayed on the display device 112 by using computer graphics and the image data.

Figure 14:
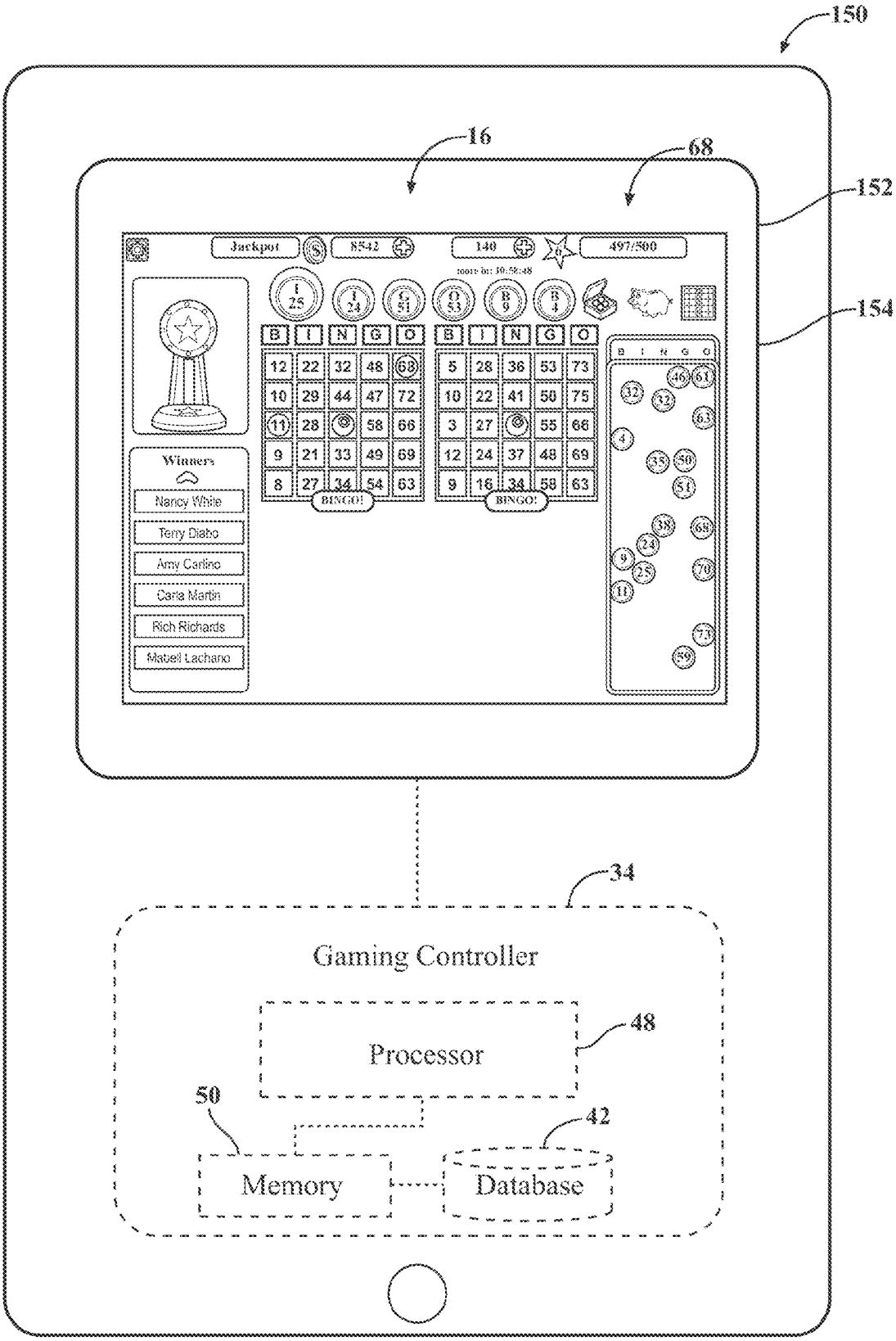
FIG. 14 is a schematic view of a gaming device for allowing a player to play a bingo-type game, according to an embodiment of the invention.

FIG. 14 is a schematic view of a gaming device 150 for allowing a player to play the bingo-type game 68, according to an embodiment of the invention. The gaming device 150 may be a smartphone, a personal computer, laptop, cell phone, tablet computer, smartphone/tablet computer hybrid, personal data assistant, and/or any suitable computing device that displays the graphical interfaces 16 and enables the user to play the bingo-type game 68. In the illustrated embodiment, the gaming device 150 includes a display device 152 such as, for example, display device 30, a user input device 154 such as, for example, user input device 32, and the gaming controller 34 coupled to the display device 152 and the user input device 154.

The gaming controller 34 includes the processor 48 and the memory device 50 that is coupled to the processor 48. The memory device 50 stores programs and information used by the processor 48 including, but not limited to, image data for producing images and/or screens on the display device 152, game indicia, symbol weights, paytables, and/or winning combination tables which represent relationships between combinations of random numbers, combinations of symbol matches and types of awards associated with the bingo-type game 68

The processor 48 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the gaming controller 34 to store, retrieve, and/or execute instructions and/or data. The gaming controller 34 in particular executes a game program to implement the method 200 and thereby conducts a game in accordance with the embodiments described herein.

Figure 15:
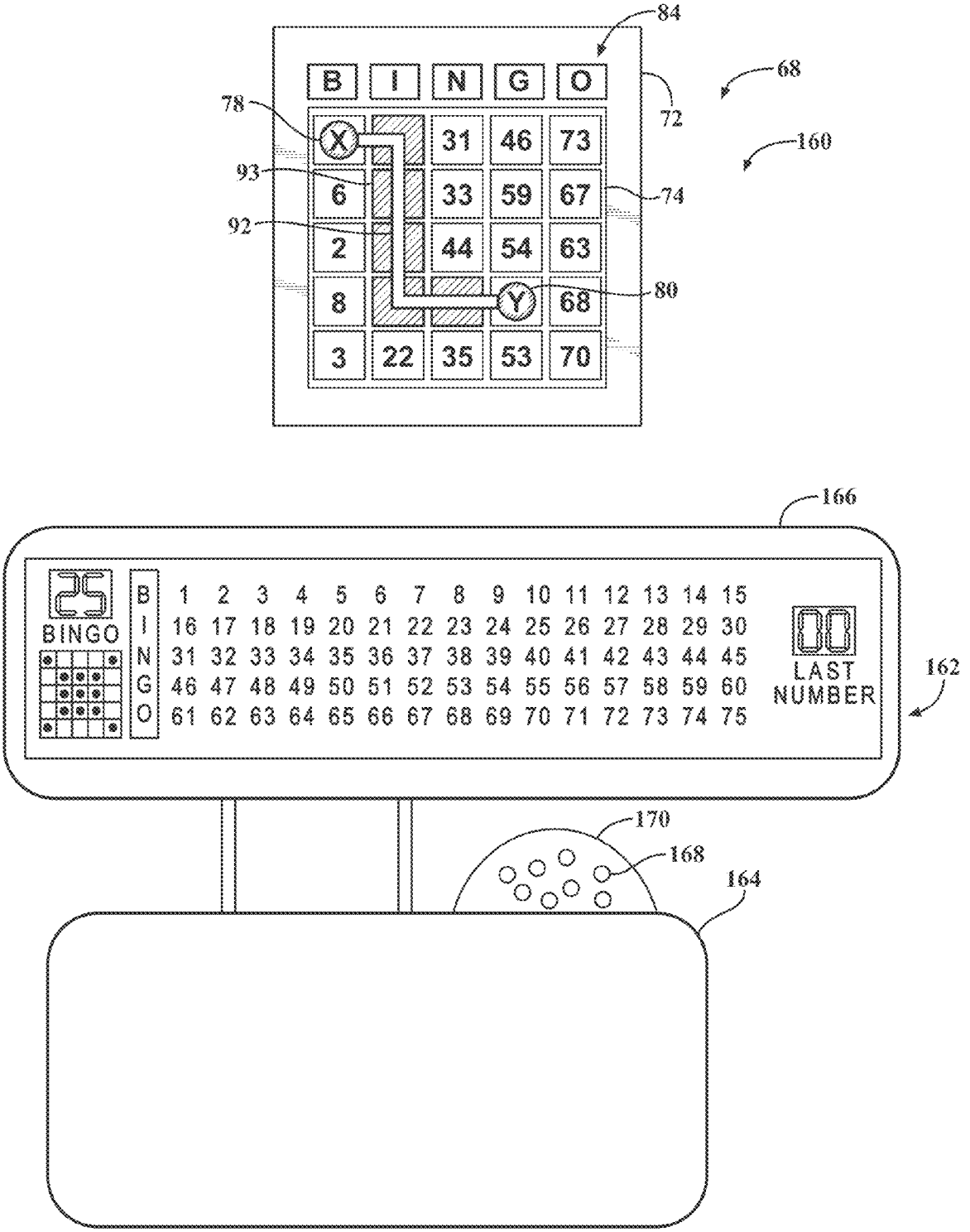
FIG. 15 is a schematic view of another system for allowing a player to play a bingo-type game, according to an embodiment of the invention.
Figure 16:
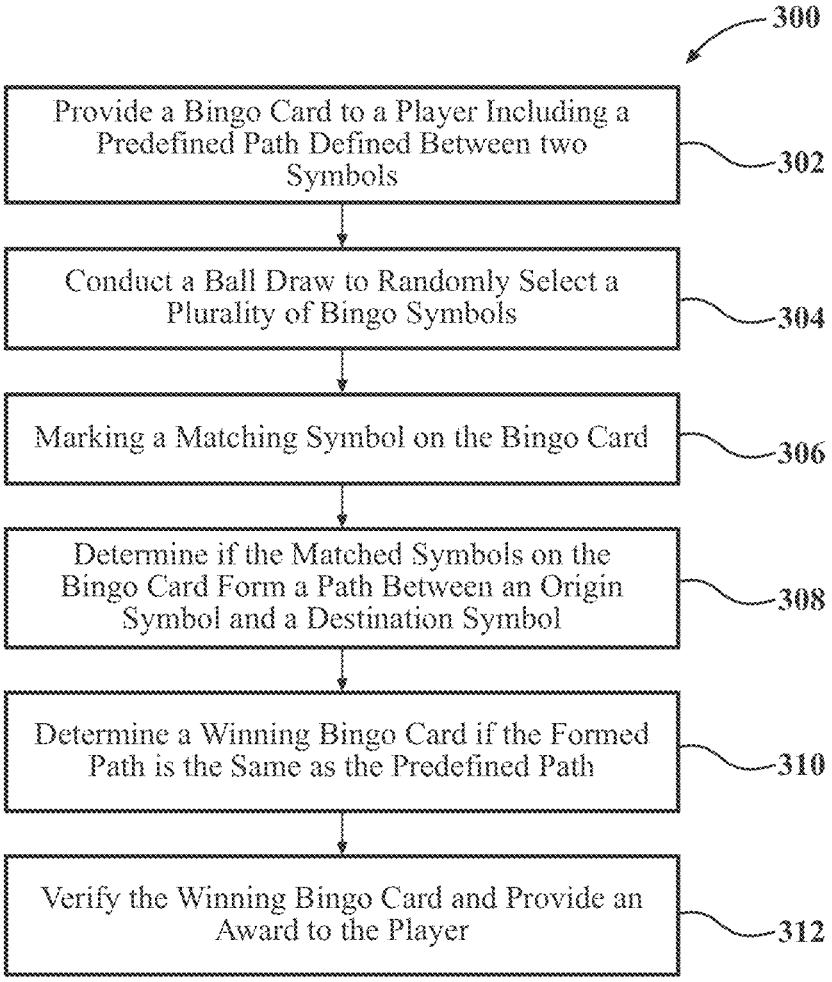
FIG. 16 is a flowchart of a method that may be used with the system shown in FIG. 14, according to an embodiment of the invention.

FIG. 15 is a schematic view of another system 160 for allowing a player to play the bingo-type game 68, according to an embodiment of the invention. FIG. 16 is a flowchart of a method 300 that may be used with the system 160. Each method step may be performed independently of, or in combination with, other method steps. Portions of the method 300 may be performed by any one of, or any combination of, the components of the system 160. In the illustrated embodiment, the system 160 includes a bingo draw machine 162 and a plurality of bingo cards 72. The bingo draw machine 162 includes a draw unit 164 and a display unit 166. The display unit 166 may include, for example, the display device 30, and is configured to display a grid including a plurality of letters including "B", "I", "N", "G", and "O" and a plurality of numbers corresponding to each letter. The numbers are selected from a predefined set of numbers that are associated with each letter. The draw unit 164 includes a plurality of bingo balls 168 contained within a ball chamber 170. Each bingo ball 168 includes indicia indicative of a game symbol including a bingo letter and a unique number selected from the predefined set of numbers. During a bingo draw, the draw unit 164 randomly shuffles and/or moves the plurality of bingo balls 168 within the ball chamber 170. An operator then selects one of the plurality of bingo balls 168 from the ball chamber 170 and announces the selected bingo ball 168. More specifically, the operator announces the letter and number combination inscribed on the selected bingo ball 168 and displays the letter and number combination inscribed on the selected bingo ball 168 on the display unit 166.

In another embodiment, the system 160 may include a card shuffler (not shown) that randomly shuffles a deck of cards that includes the cards corresponding to the predefined set of game symbol 66 and/or predefined set of numbers. A dealer deals a set of cards from the deck of cards and determines if the dealt cards match the symbols and/or numbers displayed on each of the bingo cards 72.

Each bingo card 72 includes a grid 84 including a row of letters including "B", "I", "N", "G", and "O" a columns corresponding to each letter. Each column includes a plurality of numbers that are randomly selected from the predefined set of numbers. In the illustrated embodiment, each bingo card 72 includes a plurality of player symbols 74 including an origin symbol 78 and a destination symbol 80 displayed in the grid 84. For example, in one embodiment, the origin symbol 78 and the destination symbol 80 each correspond to a different number being displayed in a column associated with a letter. The origin symbol 78 and the destination symbol 80 may each be displayed in the same column, the same row, different columns, and/or different rows.

In the illustrated embodiment, at least one bingo card 72 includes a predefined path 92 being displayed between the origin symbol 78 and the destination symbol 80. The predefined path 92 may extend over a plurality of adjacent bingo numbers or may extend over one bingo number. In addition, the bingo card 72 may include one or more origin symbols 78 and/or one or more destination symbols 80. Moreover, the bingo card 72 may include one or more paths 92 extending between the origin symbols 78 and the destination symbols 80. Many variations to the above described bingo card 72 including on or more paths 92 formed between one or more origin symbols 78 and one or more destination symbols 80 fall within the scope of the present invention.

In the illustrated embodiment, the method step 302 includes providing the bingo card 72 to a player, wherein the bingo card 72 includes a plurality of game symbols including at least one origin symbol 78, at least one destination symbol 80, and a predefined path 92 displayed between the origin symbol 78 and the destination symbol 80. In method step 304, a ball draw is conducted, wherein a plurality of bingo balls 168 indicative of corresponding game symbols are randomly selected. In one embodiment, a bingo caller (not shown) randomly selects a bingo ball 168 from the draw unit 164 and announces the letter-number combination associated with the selected ball 168 and displays the selected letter-number combination on the display unit 166.

In the illustrated embodiment, the method step 306 includes marking and/or daubing the selected letter-number combination on the bingo card 72 if the bingo card 72 includes the selected letter-number combination. More specifically, the player determines if the bingo card 72 includes the announced letter-number combination and daubs the bingo card 72 accordingly.

Method step 308 includes determining if the marked letter-number combination on the bingo card 72 forms a path 92 between the origin symbol 78 and the destination symbol 80. Method step 310 includes determining the bingo card 72 to be a winning bingo card if the marked path 92 is the same as the predefined path 92 displayed on the bingo card 72. Moreover, the player determines if each letter-number combination forming the predefined path 92 has been selected by the bingo caller, and responsively announces a winning bingo card 72.

Method step 312 includes verifying the winning bingo card 72 and responsively providing an award to the player. If a winning bingo card 72 has not been announced and/or verified, the bingo caller continues the ball draw until a winning bingo card is determined.

The above-described systems and methods overcome at least some disadvantages of known systems by allowing a player to purchase a bingo card that includes a plurality of player symbols including at least one origin symbol and at least one destination symbol, randomly selecting a plurality of game symbols, determining whether the selected game symbols match the player symbols, determining if the matched player symbols form a path extending between the origin symbol and the destination symbol, and responsively providing an award to the player based on the formed path. By providing an award to player based on a path formed by matched player symbols, the player's expectation of achieving a winning outcome with the purchased bingo card is increased, thus increasing the amount of bingo cards purchased by the player and increasing the amount of revenue received from the purchases.

Exemplary embodiments of a system and method of allowing a player to play a bingo-type game that includes a winning condition based on a path formed between two game symbols via a mobile computing device are described above in detail. The system and method are not limited to the specific embodiments described herein, but rather, components of the system and/or steps of the method may be utilized independently and separately from other components and/or steps described herein. For example, the system may also be used in combination with other wagering systems and methods, and is not limited to practice with only the system as described herein. Rather, an exemplary embodiment can be implemented and utilized in connection with many other wagering applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system or incorporated in an existing gaming system. The system of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine that implements a bingo-type game, comprising:

a validation device configured to receive from a user, and to validate, one or more physical objects representing a monetary value, and to determine the monetary value associated with the one or more received physical objects;

a display device;

a controller that comprises a processor and a memory, the controller coupled to the validation device and the display device, the controller configured to maintain, for a user, a count of gaming credits available to a user, the count of gaming credits based on the monetary value of the one or more physical objects received from the user and based further on outcomes of the bingo-type game; and executable program instructions stored in the memory, wherein the executable program instructions instruct the processor to implement the bingo-type game by a process that comprises:

randomly generating, for the bingo-type game, a grid that includes a plurality of player symbols arranged in rows and columns, the plurality of player symbols including an origin symbol and a destination symbol;

randomly selecting a plurality of game symbols for the user;

instructing the display device to display an interactive user interface that displays the grid and the plurality of game symbols;

detecting matches between the player symbols and the game symbols, and instructing the display device to update the interactive user interface to visually represent each match;

determining whether the matches between the player symbols and game symbols form one of a plurality of paths between the origin symbol and destination symbol on the grid, the plurality of paths each representing a winning condition, the plurality of paths including a least one path that includes a horizontal sub-path connected to a vertical sub-path, the horizontal sub-path comprising multiple consecutive player symbols of a row, and the vertical sub-path comprising multiple consecutive player symbols of a column;

determining a game outcome based at least partly on whether one or more of the plurality of paths is formed from the matches; and updating the count of gaming credits to reflect the game outcome.

2. The gaming machine of claim 1, wherein the grid comprises a single origin symbol and multiple destination symbols, and the process comprises determining whether the matches form respective paths from the origin symbol to each of the destination symbols.

3. The gaming machine of claim 1, wherein the grid comprises (1) a first symbol pair comprising a first origin symbol and a first destination symbol, and (2) a second symbol pair comprising a second origin symbol and a second destination symbol, and the process comprises determining whether the matches create:

a first path between the first origin symbol and first destination symbol; and a second path between the second origin symbol and second destination symbol.

4. The gaming machine of claim 1, wherein the validation device comprises a bill acceptor that receives and validates monetary bills.

5. The gaming machine of claim 4, further comprising a credit controller configured to output cash or a credit voucher to the user based on the count of gaming credits.

6. The gaming machine of claim 1, wherein the validation device comprises a coin slot.

* * * * *